US010934795B2

(12) United States Patent
Wells

(10) Patent No.: US 10,934,795 B2
(45) Date of Patent: Mar. 2, 2021

(54) SYSTEMS AND METHODS FOR SETTING A DOWNHOLE PLUG

(71) Applicant: G&H Diversified Manufacturing LP, Houston, TX (US)

(72) Inventor: Joe Noel Wells, Lindale, TX (US)

(73) Assignee: G&H Diversified Manufacturing LP, Houston, TX (US)

( * ) Notice: Subject to any disclaimer, the term of this patent is extended or adjusted under 35 U.S.C. 154(b) by 0 days.

(21) Appl. No.: 16/152,222

(22) Filed: Oct. 4, 2018

(65) Prior Publication Data

US 2019/0106956 A1 Apr. 11, 2019

Related U.S. Application Data

(60) Provisional application No. 62/569,425, filed on Oct. 6, 2017, provisional application No. 62/734,605, filed on Sep. 21, 2018.

(51) Int. Cl.
*E21B 23/06* (2006.01)
*E21B 33/12* (2006.01)

(52) U.S. Cl.
CPC ..... *E21B 23/065* (2013.01); *E21B 23/06* (2013.01); *E21B 33/12* (2013.01)

(58) Field of Classification Search
CPC ..... E21B 23/04; E21B 23/06
See application file for complete search history.

(56) References Cited

U.S. PATENT DOCUMENTS 2,692,023 A * 10/1954 Conrad ..... E21B 23/065 166/63
7,000,705 B2 2/2006 Buyers et al.
7,353,871 B2 * 4/2008 Hromas ..... E21B 17/06 166/297
7,913,770 B2 3/2011 Schramm et al.
8,196,515 B2 6/2012 Streibich et al.
8,517,115 B2 8/2013 Watson
8,881,834 B2 11/2014 Lauderdale
9,512,689 B2 12/2016 Frazier
9,771,769 B2 9/2017 Baker et al.
9,810,035 B1 11/2017 Carr et al.
9,890,604 B2 2/2018 Wood et al.
10,060,213 B2 8/2018 Maenza et al.
(Continued)

FOREIGN PATENT DOCUMENTS

WO 2016144314 A1 9/2016

OTHER PUBLICATIONS

International Search Report and Written Opinion dated Jan. 30, 2019, for Application No. PCT/US2018/054442.

*Primary Examiner* — Tara Schimpf
*Assistant Examiner* — Dany E Akakpo
(74) *Attorney, Agent, or Firm* — Conley Rose, P.C.

(57) ABSTRACT

A tool string disposable in a wellbore includes a plug configured to seal against an inner surface of a tubular string disposed in the wellbore, a setting tool coupled to the plug, including a housing including a central passage, a mandrel slidably disposed in the housing, wherein the mandrel includes an outer surface including a planar surface, and a piston coupled to the mandrel and including a central passage, wherein, in response to a pressurization of the central passage of the piston of the setting tool, the setting tool is configured to actuate the plug to seal against the inner surface of the tubular string.

21 Claims, 5 Drawing Sheets

(56) References Cited

U.S. PATENT DOCUMENTS

| | | | |
|---|---|---|---|
| 10,246,961 | B2 | 4/2019 | Robertson et al. |
| 10,352,119 | B2 | 7/2019 | Doane et al. |
| 10,352,120 | B2 | 7/2019 | Ewing et al. |
| 2006/0048940 | A1 | 3/2006 | Hromas |
| 2013/0284426 | A1 | 10/2013 | Watson |
| 2016/0369588 | A1 | 12/2016 | Davies et al. |
| 2017/0081938 | A1 | 3/2017 | Richards et al. |

* cited by examiner

SYSTEMS AND METHODS FOR SETTING A DOWNHOLE PLUG

CROSS-REFERENCE TO RELATED APPLICATIONS

This application claims benefit of U.S. provisional patent application Ser. No. 62/569,425 filed Oct. 6, 2017, and entitled "Setting Tool," and U.S. provisional patent application Ser. No. 62/734,605 filed Sep. 21, 2018, and entitled "Setting Tool," each of which is hereby incorporated herein by reference in its entirety.

STATEMENT REGARDING FEDERALLY SPONSORED RESEARCH OR DEVELOPMENT

Not applicable.

BACKGROUND

After a wellbore has been drilled through a subterranean formation, the wellbore may be cased by inserting lengths of pipe ("casing sections") connected end-to-end into the wellbore. Threaded exterior connectors known as casing collars may be used to connect adjacent ends of the casing sections at casing joints, providing a casing string including casing sections and connecting casing collars that extends from the surface towards the bottom of the wellbore. The casing string may then be cemented into place to secure the casing string within the wellbore.

In some applications, following the casing of the wellbore, a wireline tool string may be run into the wellbore as part of a "plug-n-perf" hydraulic fracturing operation. The wireline tool string may include a perforating gun for perforating the casing string at a desired location in the wellbore, a downhole plug that may be set to couple with the casing string at a desired location in the wellbore, and a setting tool for setting the downhole plug. In certain applications, once the casing string has been perforated by the perforating gun and the downhole plug has been set, a ball or dart may be pumped into the wellbore for landing against the set downhole plug, thereby isolating the portion of the wellbore extending uphole from the set downhole plug. With this uphole portion of the wellbore isolated, the formation extending about the perforated section of the casing string may be hydraulically fractured by fracturing fluid pumped into the wellbore.

SUMMARY OF THE DISCLOSURE

An embodiment of a tool string disposable in a wellbore comprises a plug configured to seal against an inner surface of a tubular string disposed in the wellbore, and a setting tool coupled to the plug, comprising a housing comprising a central passage, a mandrel slidably disposed in the housing, wherein the mandrel comprises an outer surface including a planar surface, and a piston coupled to the mandrel and comprising a central passage, wherein, in response to a pressurization of the central passage of the piston of the setting tool, the setting tool is configured to actuate the plug to seal against the inner surface of the tubular string. In some embodiments, the mandrel of the setting tool comprises a plurality of the planar surfaces and wherein the planar surfaces are circumferentially spaced about the mandrel. In some embodiments, the housing of the setting tool is coupled to a housing of the plug, and the mandrel of the setting tool is coupled to a mandrel of the plug, and wherein displacement of the mandrel of the setting tool results in displacement of the mandrel of the plug. In certain embodiments, the tool string further comprises a firing head coupled to the setting tool, a wireline extending from the tool string to a surface of the wellbore, and a pressure charge disposed in the setting tool, wherein the firing head comprises an ignitor ballistically coupled to the pressure charge and is configured to ignite the pressure charge in response to receiving a signal transmitted by the wireline. In certain embodiments, the tubular string comprises a casing string.

An embodiment of a setting tool for actuating a plug in a wellbore comprises a housing comprising a central passage, a mandrel slidably disposed in the housing, a piston coupled to the mandrel and comprising a central passage, and an annular seal positioned between the mandrel and the housing, wherein the annular seal forms a first chamber and a second chamber in the housing, wherein the mandrel comprises a first position in the housing and a second position in the housing axially spaced from the first position, wherein fluid communication between the first chamber and the second chamber is restricted when the mandrel is in the first position, and wherein fluid communication is permitted between the first chamber and the second chamber when the mandrel is in the second position, wherein, in response to a pressurization of the central passage of the piston, the setting tool is configured to displace the mandrel between the first position and the second position. In some embodiments, an opening is formed between an outer surface of the mandrel and an inner surface of the housing when the mandrel is in the second position, and wherein the opening comprises a flowpath for providing fluid communication between the first chamber and the second chamber. In some embodiments, the opening comprises an arcuate opening formed between a planar surface of the mandrel and the inner surface of the housing. In certain embodiments, the opening comprises an annular passage formed between a cylindrical groove of the mandrel and the inner surface of the housing. In some embodiments, the annular seal sealingly engages an outer surface of the mandrel when the mandrel is in the first position, and the annular seal does not sealingly engage the outer surface of the mandrel when the mandrel is in the second position. In some embodiments, the piston comprises a port extending at an angle between an inner surface of the piston and an end of the piston. In some embodiments, the setting tool further comprises a pressure charge disposed in the central passage of the piston, wherein the pressure charge is configured to ignite and thereby pressurize the first chamber. In certain embodiments, the mandrel comprises an outer surface including a planar surface. In certain embodiments, the mandrel comprises an outer surface including a cylindrical groove. In some embodiments, the setting tool further comprises a vent port extending radially through the housing, wherein the vent port is configured to vent pressure from the second chamber to the environment surrounding the setting tool when the mandrel is displaced towards the second position.

An embodiment of a method for setting a plug in a wellbore comprises pressurizing a first chamber disposed in a housing of a setting tool coupled to the plug, restricting fluid communication between the first chamber and a second chamber disposed in the housing, displacing a mandrel through a central passage of the housing from a first position to a second position axially spaced from the first position in response to pressurizing the first chamber, and venting pressure from the first chamber to the second chamber in response to displacing the mandrel from the first position to the second position. In some embodiments, the method further comprises sealing an inner surface of a string disposed in the wellbore with the plug in response to displacing the mandrel from the first position to the second position. In some embodiments, the method further comprises flowing a fluid from the first chamber to the second chamber through at least one opening formed between an outer surface of the mandrel and an inner surface of the housing. In certain embodiments, the opening comprises an arcuate opening formed between a planar surface of the mandrel and the inner surface of the housing. In certain embodiments, the opening comprises an annular passage formed between a cylindrical groove of the mandrel and the inner surface of the housing.

BRIEF DESCRIPTION OF THE DRAWINGS

For a detailed description of exemplary embodiments of the disclosure, reference will now be made to the accompanying drawings in which.

DETAILED DESCRIPTION

Figure 1:
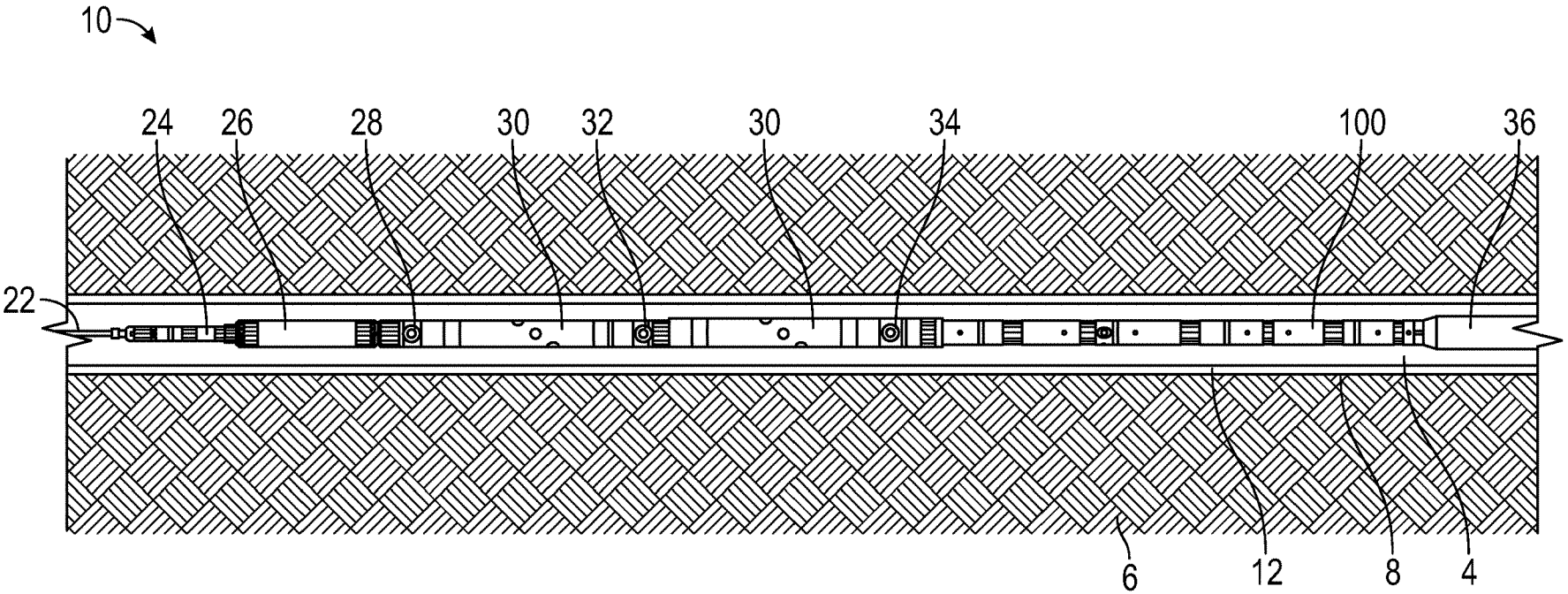
FIG. 1 is a schematic, partial cross-sectional view of a system for completing a subterranean well including an embodiment of a setting tool in accordance with the principles disclosed herein.
Figure 2:
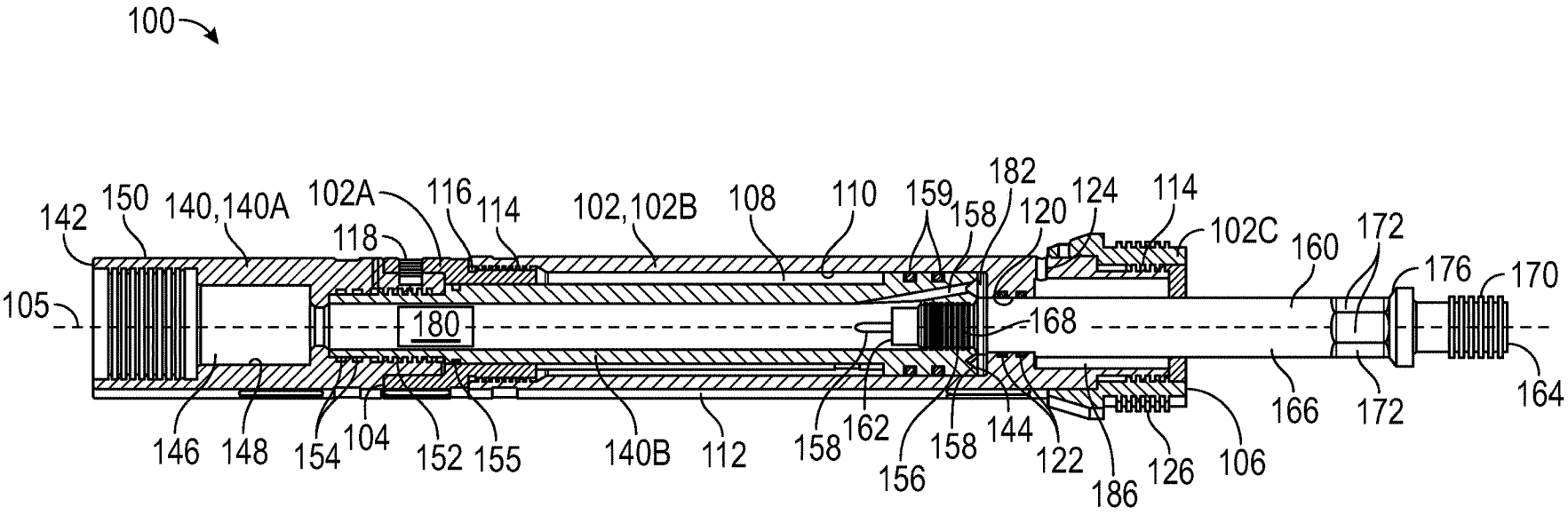
FIG. 2 is a side cross-sectional view of the setting tool of FIG. 1 in a run-in position in accordance with principles disclosed herein.
Figure 3:
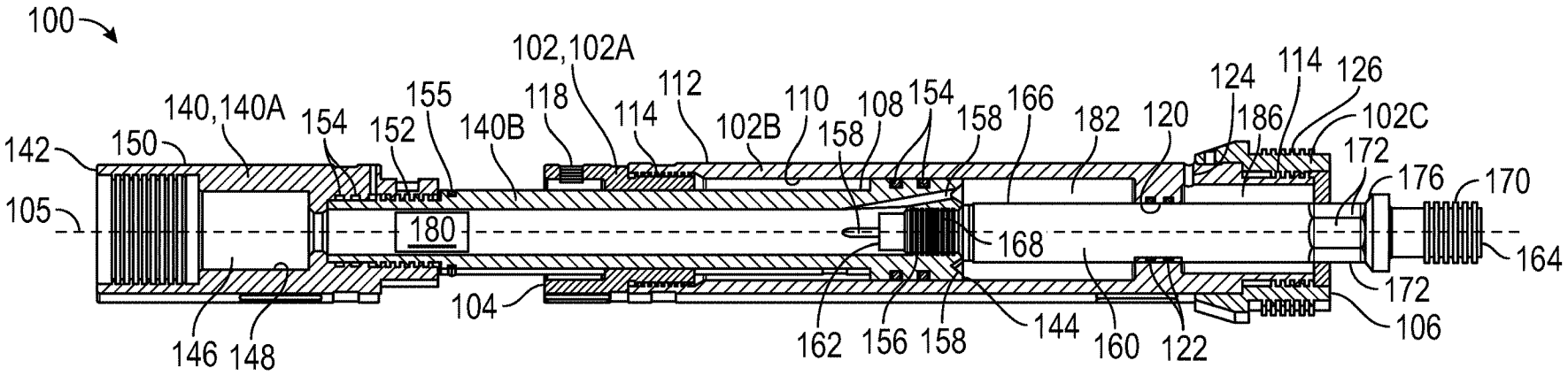
FIG. 3 is a side cross-sectional view of the setting tool of FIG. 1 in a mid-stroke position in accordance with principles disclosed herein.

The following discussion is directed to various exemplary embodiments. However, one skilled in the art will understand that the examples disclosed herein have broad application, and that the discussion of any embodiment is meant only to be exemplary of that embodiment, and not intended to suggest that the scope of the disclosure, including the claims, is limited to that embodiment. Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection, or through an indirect connection via other devices, components, and connections. In addition, as used herein, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis. Any reference to up or down in the description and the claims is made for purposes of clarity, with "up", "upper", "upwardly", "uphole", or "upstream" meaning toward the surface of the borehole and with "down", "lower", "downwardly", "downhole", or "downstream" meaning toward the terminal end of the borehole, regardless of the borehole orientation. Further, the term "fluid," as used herein, is intended to encompass both fluids and gasses.

Referring now to FIG. 1, a system 10 for completing a wellbore 4 extending into a subterranean formation 6 is shown. In the embodiment of FIG. 1, wellbore 4 is a cased wellbore including a casing string 12 secured to an inner surface 8 of the wellbore 4 using cement (not shown). In some embodiments, casing string 12 generally includes a plurality of tubular segments coupled together via a plurality of casing collars. In this embodiment, completion system 10 includes a tool string 20 disposed within wellbore 4 and suspended from a wireline 22 that extends to the surface of wellbore 4. Wireline 22 comprises an armored cable and includes at least one electrical conductor for transmitting power and electrical signals between tool string 20 and the surface. System 10 may further include suitable surface equipment for drilling, completing, and/or operating completion system 10 and may include, in some embodiments, derricks, structures, pumps, electrical/mechanical well control components, etc. Tool string 20 is generally configured to perforate casing string 12 to provide for fluid communication between formation 6 and wellbore 4 at predetermined locations to allow for the subsequent hydraulic fracturing of formation 6 at the predetermined locations.

In this embodiment, tool string 20 generally includes a cable head 24, a casing collar locator (CCL) 26, a direct connect sub 28, a plurality of perforating guns 30, a switch sub 32, a plug-shoot firing head 34, a setting tool 100, and a downhole or frac plug 36 (shown schematically in FIG. 1). Cable head 24 is the uppermost component of tool string 20 and includes an electrical connector for providing electrical signal and power communication between the wireline 22 and the other components (CCL 26, perforating guns 30, setting tool 100, etc.) of tool string 20. CCL 26 is coupled to a lower end of the cable head 24 and is generally configured to transmit an electrical signal to the surface via wireline 22 when CCL 26 passes through a casing collar, where the transmitted signal may be recorded at the surface as a collar kick to determine the position of tool string 20 within wellbore 4 by correlating the recorded collar kick with an open hole log. The direct connect sub 28 is coupled to a lower end of CCL 26 and is generally configured to provide a connection between the CCL 26 and the portion of tool string 20 including the perforating guns 30 and associated tools, such as the setting tool 100 and downhole plug 36.

Perforating guns 30 of tool string 20 are coupled to direct connect sub 28 and are generally configured to perforate casing string 12 and provide for fluid communication between formation 6 and wellbore 4. Particularly, perforating guns 30 include a plurality of shaped charges that may be detonated by a signal conveyed by the wireline 22 to produce an explosive jet directed against casing string 12. Perforating guns 30 may be any suitable perforation gun known in the art while still complying with the principles disclosed herein. For example, in some embodiments, perforating guns 30 may comprise a hollow steel carrier (HSC) type perforating gun, a scalloped perforating gun, or a retrievable tubing gun (RTG) type perforating gun. In addition, gun 30 may comprise a wide variety of sizes such as, for example, 2¾", 3⅛", or 3⅜", wherein the above listed size designations correspond to an outer diameter of perforating guns 30.

Switch sub 32 of tool string 20 is coupled between the pair of perforating guns 30 and includes an electrical conductor and switch generally configured to allow for the passage of an electrical signal to the lowermost perforating gun 30 of tool string 20. Tool string 20 further includes plug-shoot firing head 34 coupled to a lower end of the lowermost perforating gun 30. Plug-shoot firing head 34 couples the perforating guns 30 of the tool string 20 to the setting tool 100 and downhole plug 36, and is generally configured to pass a signal from the wireline 22 to the setting tool 100 of tool string 20. Plug-shoot firing head 34 may also include mechanical and/or electrical components to fire the setting tool 100.

In this embodiment, tool string 20 further includes setting tool 100 and downhole plug 36, where setting tool 100 is coupled to a lower end of plug-shoot firing head 34 and is generally configured to set or install downhole plug 36 within casing string 12 to isolate desired segments of the wellbore 4, as will be discussed further herein. Once downhole plug 36 has been set by setting tool 100, an outer surface of downhole plug 36 seals against an inner surface of casing string 12 to restrict fluid communication through wellbore 4 across downhole plug 36. Downhole plug 36 of tool string 20 may be any suitable downhole or frac plug known in the art while still complying with the principles disclosed herein. Additionally, although setting tool 100 is shown in FIG. 1 as incorporated in tool string 20, setting tool 100 may be used in other tool strings comprising components differing from the components comprising tool string 20.

Referring to FIGS. 1-5, an embodiment of the setting tool 100 of the tool string 20 of FIG. 1 is shown in FIGS. 2-5. In the embodiment of FIGS. 2-5, setting tool 100 has a central or longitudinal axis 105 and generally includes an outer housing 102, a piston 140 slidably disposed at least partially in housing 102, and a mandrel 160 slidably disposed at least partially in housing 102. In some embodiments, piston 140 comprises a firing head adapter 140 for coupling setting tool 100 with plug-shoot firing head 34. Housing 102 of setting tool 100 has a first end 104, a second end 106 axially spaced from first end 104, a central bore or passage 108 defined by a generally cylindrical inner surface 110 extending between ends 104, 106, and a generally cylindrical outer surface 112 extending between ends 104, 106. In this embodiment, housing 102 comprises a plurality of tubular segments 102A, 102B, and 102C coupled together via releasable or threaded connectors 114; however, in other embodiments, housing 102 of setting tool 100 may comprise a single, unitary member. Additionally, an annular seal 116 is positioned radially between tubular segments 102A and 102B of housing 102 to seal the connection formed therebetween from the environment surrounding setting tool 100 (e.g., wellbore 4).

In this embodiment, housing 102 includes at least one shear pin 118 that extends radially into central passage 108 from inner surface 110 and is frangibly connected to piston 140. As will be discussed further herein, shear pin 118 restricts relative axial movement between piston 140 and housing 102 prior to the actuation of setting tool 100. Additionally, in this embodiment, the inner surface 110 of housing 102 includes a radially inwards extending shoulder or flange 120 located proximal second end 106. The inner surface 112 of flange 120 includes a pair of axially spaced annular seals 122 that sealingly engage mandrel 160 of setting tool 100. Housing 102 also includes at least one vent port 124 axially located between flange 120 and second end 106, where vent port 124 extends radially between inner surface 110 and outer surface 112 of housing 102. In this configuration, vent port 124 provides fluid communication between at least a portion of central passage 108 of housing 102 and the environment surrounding setting tool 100. In this embodiment, the outer surface 112 of housing 102 further includes a releasable or threaded connector 126 at second end 106 for threadably connecting with a corresponding connector of downhole plug 36 (not shown in FIGS. 2-5). Although in this embodiment the housing 102 of setting tool 100 includes vent port 124, in other embodiments, the housing 102 of setting tool 100 may not include a vent port.

Piston 140 of setting tool 100 has a first end 142, a second end 144 axially spaced from first end 142, a central bore or passage 146 defined by a generally cylindrical inner surface 148 extending between ends 142, 144, and a generally cylindrical outer surface 150 extending between ends 142, 144. In this embodiment, piston 140 comprises a plurality of tubular segments 140A, 140B coupled together via a releasable or threaded connector 152; however, in other embodiments, piston 140 of setting tool 100 may comprise a single, unitary member. Additionally, a pair of annular seals 154 are positioned radially between tubular segments 140A, 140B of piston 140 to seal the connection formed therebetween from central passage 108 of housing 102 and the environment surrounding setting tool 100 (e.g., wellbore 4). Further, an annular seal 155 is positioned adjacent to connector 152 to sealingly engage the inner surface 110 of housing 102.

In this embodiment, the inner surface 148 of piston 140 includes a releasable or threaded connector 156 located at second end 144 for releasably connecting to a corresponding connector of mandrel 160. Although in this embodiment piston 140 and mandrel 160 comprise distinct, releasably connectable members, in other embodiments, piston 140 and mandrel 160 may comprise a single, unitary member. In this embodiment, piston 140 includes one or more circumferentially spaced ports 158 that extend at an angle relative to central axis 105 of setting tool 100. Particularly, each port 158 includes a first end formed at the inner surface 148 and a second end formed at the second end 144 of piston 140. In this configuration, the second end of each port 158 is disposed circumferentially about and radially spaced from central passage 146. Further, piston 140 includes a pair of annular seals 159 disposed on outer surface 150 and located proximal second end 144. Seals 159 of piston 140 sealingly engage the inner surface 110 of housing 102.

Mandrel 160 of setting tool 100 has a first end 162, a second end 164 axially spaced from first end 162, and a generally cylindrical outer surface 166 extending between ends 162, 164. In this embodiment, the outer surface 166 of mandrel 160 includes a first releasable or threaded connector 168 located at first end 162 and a second releasable or threaded connector 170 located at second end 164. First releasable connector 168 of mandrel 160 threadably connects to the releasable connector 156 of piston 140 to thereby releasably connect piston 140 with mandrel 160. Second releasable connector 170 of mandrel 160 releasably or threadably connects with a corresponding connector of a mandrel of downhole plug 36 (not shown in FIGS. 2-5).

In this embodiment, the outer surface 166 of mandrel 160 includes a plurality of axially aligned and circumferentially spaced planar or uncurved surfaces 172, where each planar surface 172 extends axially a distance equal to or greater than the axial spacing between annular seals 122 of housing 102. As shown particularly in FIG. 5, the arrangement of planar surfaces 172 forms a hexagonal cross-section 174 that has a maximum width 174A and a minimum width 174B. As will be discussed further herein, the maximum width 174A of hexagonal cross-section 174 is similar or substantially equal to an inner diameter 120D of the flange 120 of housing 102 while minimum width 174B of hexagonal cross-section 174 is less than the inner diameter 120D of flange 120. In this embodiment, the outer surface 166 of mandrel 160 includes a radially outwards extending annular shoulder 176 axially located between planar surfaces 172 and releasable connector 170. Shoulder 176 has a larger diameter than the inner diameter 120D of the flange 120 of housing 102, thereby preventing shoulder 176 from passing through flange 120.

Figure 5:
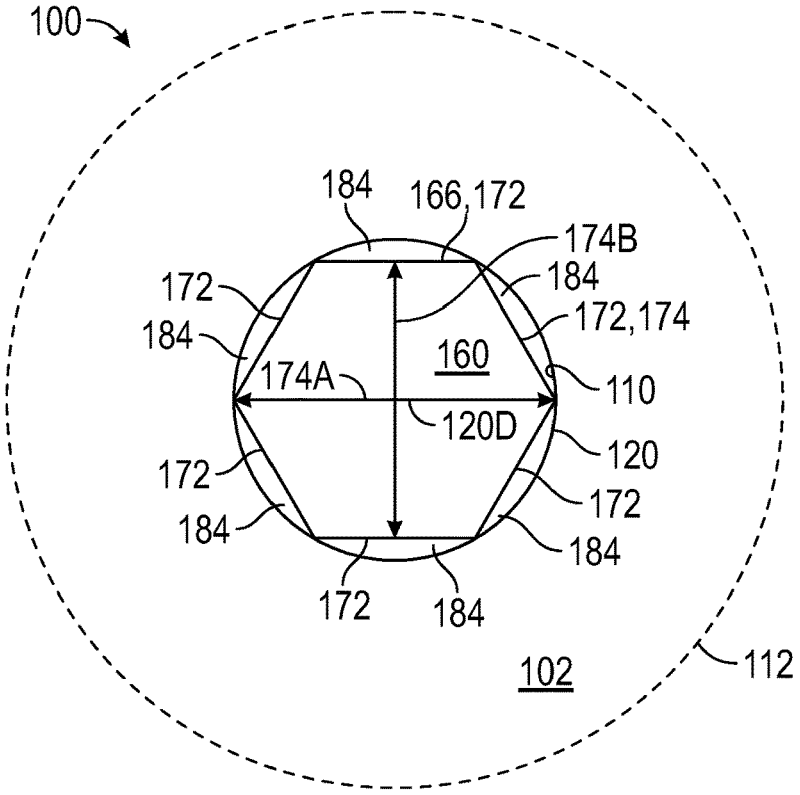
FIG. 5 a cross-sectional view along lines 5-5 in FIG. 4 of the setting tool in the full-stroke position.
Figure 6:
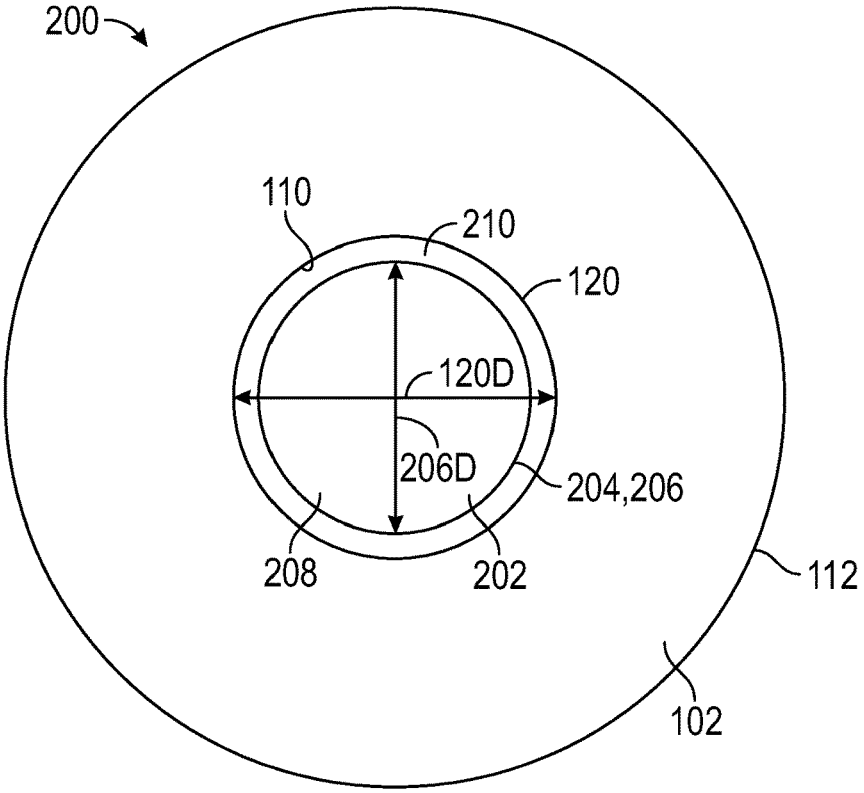
FIG. 6 is a cross-sectional view of another embodiment of a setting tool in accordance with principles disclosed herein.

Referring briefly to FIG. 6, another embodiment of a setting tool 200 for use with tool string 20 (in lieu of setting tool 100 shown in FIGS. 2-5) is shown in FIG. 6. Setting tool 200 includes features in common with the setting tool 100 shown in FIGS. 2-5, and shared features are labeled similarly. Particularly, setting tool 200 is similar in configuration as the setting tool 100 shown in FIGS. 2-5 except that setting tool 200 includes a mandrel 202 having an outer surface 204 that includes a cylindrical groove 206 in lieu of the plurality of planar surfaces 172 of the mandrel 160 of setting tool 100 (mandrel 202 is otherwise configured similarly as mandrel 160). Annular groove 206 forms a circular cross-section 208 having an outer diameter 206D that is less than the inner diameter 120D of the flange 120 of housing 102. In the embodiment of FIG. 6, an annular opening or passage 210 is formed between annular groove 206 and the inner surface 110 of flange 120. Thus, fluid pressure in pressure chamber 182 created by the ignition of power charge 180 is permitted to vent to an annular second or vent chamber 186 via annular passage 210 along the fluid flowpath 185, where vent chamber 186 is disposed about mandrel 202 and extending axially between seals 122 of flange 120 and the second end 106 of housing 102.

Referring again to FIGS. 1-5, as described above, setting tool 100 is pumped downhole though wellbore 4 along with the other components of tool string 20. As tool string 20 is pumped through wellbore 4, the position of tool string 20 in wellbore 4 is monitored at the surface via signals generated from CCL 26 and transmitted to the surface using wireline 22. Once tool string 20 is disposed in a desired location in wellbore 4, setting tool 100 may be fired or actuated from the run-in position shown in FIG. 2 to the full-stroke position shown in FIGS. 4 and 5 to thereby set the downhole plug 36 of tool string 20, and one or more of perforating guns 30 may subsequently be fired to perforate casing 12 at the desired location.

Particularly, when setting tool 100 is run through wellbore 4 along with tool string 20, housing 102 is connected to an outer housing (not shown) of downhole plug 36 via releasable connector 126 and mandrel 160 of setting tool 100 is connected to a mandrel (not shown) of downhole plug 36 via releasable connector 170. In this arrangement, relative axial movement between mandrel 160 and housing 102 of setting tool 100 may provide relative axial movement between the mandrel and outer housing of downhole plug 36 to thereby set downhole plug 36 such that downhole plug 36 seals against an inner surface of casing string 12. Once tool string 20 is disposed in a predetermined or desired position in wellbore 4, setting tool 100 may be set or actuated by igniting a power charge 180 (shown schematically in FIGS. 2-4) disposed in central passage 146 of piston 140. In some embodiments, power charge 180 is positioned proximal an ignitor (not shown) that is in signal communication with wireline 22. In some embodiments, the ignitor may be disposed in plug-shoot firing head 34; however, in other embodiments, it may be disposed in setting tool 100. In this manner, a firing signal may be communicated to the ignitor disposed in setting tool 100 from the surface of wellbore 4 via wireline 22 to ignite power charge 180.

Fluid (e.g., gas) pressure begins to build in the central passage 146 of piston 140 following the ignition of power charge 180, the fluid pressure in passage 146 being communicated to an annular first or pressure chamber 182 disposed about mandrel 160 and extending axially between seals 159 of piston 140 and seals 122 of the flange 120 of housing 102. Fluid pressure building in pressure chamber 182 acts against the second end 144 of piston 140, applying an axially directed upward force (e.g., in the direction of plug-shoot firing head 34) against piston 140. As shown particularly in FIG. 3, the axially directed force applied against piston 140 from fluid pressure in pressure chamber 182 shears the shear pin 118, allowing piston 140 and mandrel 10 to travel or stroke upwards in the direction of plug-shoot firing head 34. As mandrel 160 strokes upwards in concert with piston 140, mandrel 160 actuates or pulls the mandrel of downhole plug 36, thereby displacing the mandrel of downhole plug 36 relative to the outer housing of plug 36.

Figure 4:
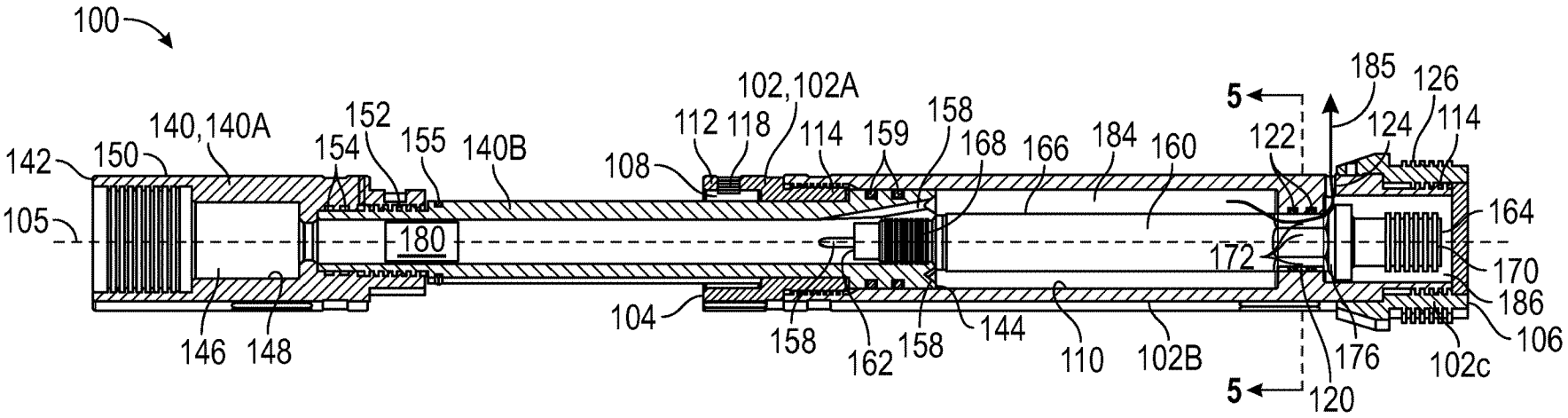
FIG. 4 is a side cross-sectional view of the setting tool of FIG. 1 in a full-stroke position in accordance with principles disclosed herein.

As shown in FIGS. 4 and 5, fluid pressure in pressure chamber 182 continues to force piston 140 and mandrel 160 axially upwards, causing the section of outer surface 166 of mandrel 160 comprising planar surfaces 172 to pass and enter into axial alignment with flange 120 of the housing 102 of setting tool 100. As shown particularly in FIG. 5, a plurality of arcuate gaps or openings 184 are formed between planar surfaces 172 of mandrel 160 and the inner surface 110 of flange 120. Thus, fluid pressure in pressure chamber 182 created by the ignition of power charge 180 is permitted to vent to an annular second or vent chamber 186 via arcuate openings 184 along a fluid flowpath (indicated by arrow 185 in FIG. 4), where vent chamber 186 is disposed about mandrel 160 and extending axially between seals 122 of flange 120 and the second end 106 of housing 102. Additionally, fluid vented to vent chamber 186 from pressure chamber 182 is vented from setting tool 100 to wellbore 4 via the vent port 124 formed in housing 102 along fluid flowpath 185. Although in this embodiment openings 184 are formed via planar surfaces 184 of mandrel 160, in other embodiments, one or more openings may be formed between mandrel 160 and flange 120 via other features located on the outer surface 166 of mandrel 160, such as axially extending grooves formed in the outer surface 166 of mandrel 160, a section of outer surface 166 having a circumferentially extending reduced diameter or width, or other features permitting fluid flow across annular seals 122. Although the operation of the setting tool 100 shown in FIGS. 2-5 is described in detail above, the setting tool 200 shown in FIG. 6 may be operated in a similar manner.

By positioning vent port 124 between seals 122 of flange 120 and the second end 106 of housing 102, pressurized fluid disposed in pressure chamber 182 is allowed to vent to the vent chamber 186 prior to entering vent port 124. In other words, the portion of housing 102 that includes vent port 124 is not exposed to the degree of fluid pressure and associated stress that the portion of housing 102 comprising pressure chamber 184 is exposed. Given that vent port 124 may reduce the strength of the portion of housing 102 in which it is located (e.g., by forming a stress-riser in the wall of housing 102), reducing the fluid pressure received by the portion of housing 102 including vent port 124 reduces the possibility of housing 102 failing during operation due to the pressure applied against the inner surface 110 of housing 102.

While exemplary embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the disclosure presented herein. For example, the relative dimensions of various parts, the materials from which the various parts are made, and other parameters can be varied. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. A tool string disposable in a wellbore, comprising:

a plug configured to seal against an inner surface of a tubular string disposed in the wellbore; and a setting tool coupled to the plug, comprising:

a housing comprising a central passage;

a mandrel slidably disposed in the housing, wherein the mandrel comprises an outer surface including a planar surface; and a piston coupled to the mandrel and comprising a central passage;

wherein, in response to a pressurization of the central passage of the piston of the setting tool, the setting tool is configured to actuate the plug to seal against the inner surface of the tubular string.

2. The tool string of claim 1, wherein the mandrel of the setting tool comprises a plurality of the planar surfaces and wherein the planar surfaces are circumferentially spaced about the mandrel.

3. The tool string of claim 1, wherein:

the housing of the setting tool is coupled to a housing of the plug; and the mandrel of the setting tool is coupled to a mandrel of the plug, and wherein displacement of the mandrel of the setting tool results in displacement of the mandrel of the plug.

4. The tool string of claim 1, further comprising:

a firing head coupled to the setting tool;

a wireline extending from the tool string to a surface of the wellbore; and a pressure charge disposed in the setting tool;

wherein the firing head comprises an ignitor ballistically coupled to the pressure charge and is configured to ignite the pressure charge in response to receiving a signal transmitted by the wireline.

5. The tool string of claim 1, wherein the tubular string comprises a casing string.

6. The tool string of claim 1, wherein:

the setting tool comprises an annular seal positioned between the mandrel and the housing, wherein the annular seal forms a first chamber and a second chamber in the housing;

the mandrel of the setting tool comprises a first position in the housing that corresponds to a run-in position of the plug, and a second position in the housing axially spaced from the first position that corresponds to a set position of the plug; and fluid communication between the first chamber and the second chamber is restricted when the mandrel is in the first position, and wherein the planar surface permits fluid communication between the first chamber and the second chamber when the mandrel is in the second position.

7. A setting tool for actuating a plug in a wellbore, comprising:

a housing comprising a central passage;

a mandrel slidably disposed in the housing;

a piston coupled to the mandrel and comprising a central passage, wherein the piston comprises a port extending at an angle between an inner surface of the piston and an end of the piston; and an annular seal positioned between the mandrel and the housing, wherein the annular seal forms a first chamber and a second chamber in the housing;

wherein the mandrel comprises a first position in the housing and a second position in the housing axially spaced from the first position;

wherein fluid communication between the first chamber and the second chamber is restricted when the mandrel is in the first position, and wherein fluid communication is permitted between the first chamber and the second chamber when the mandrel is in the second position;

wherein, in response to a pressurization of the central passage of the piston, the setting tool is configured to displace the mandrel between the first position and the second position.

8. The setting tool of claim 7, wherein an opening is formed between an outer surface of the mandrel and an inner surface of the housing when the mandrel is in the second position, and wherein the opening comprises a flowpath for providing fluid communication between the first chamber and the second chamber.

9. The setting tool of claim 8, wherein the opening comprises an arcuate opening formed between a planar surface of the mandrel and the inner surface of the housing.

10. The setting tool of claim 8, wherein the opening comprises an annular passage formed between a cylindrical groove of the mandrel and the inner surface of the housing.

11. The setting tool of claim 7, wherein:

the annular seal sealingly engages an outer surface of the mandrel when the mandrel is in the first position; and the annular seal does not sealingly engage the outer surface of the mandrel when the mandrel is in the second position.

12. The setting tool of claim 7, further comprising a pressure charge disposed in the central passage of the piston, wherein the pressure charge is configured to ignite and thereby pressurize the first chamber.

13. The setting tool of claim 7, wherein the mandrel comprises an outer surface including a planar surface.

14. The setting tool of claim 7, wherein the mandrel comprises an outer surface including a cylindrical groove.

15. The setting tool of claim 7, further comprising a vent port extending radially through the housing, wherein the vent port is configured to vent pressure from the second chamber to the environment surrounding the setting tool when the mandrel is displaced towards the second position.

16. A method for setting a plug in a wellbore, comprising:

pressurizing a first chamber disposed in a housing of a setting tool coupled to the plug;

restricting fluid communication between the first chamber and a second chamber disposed in the housing;

displacing a mandrel through a central passage of the housing from a first position to a second position axially spaced from the first position in response to pressurizing the first chamber; and venting pressure from the first chamber to the second chamber in response to displacing the mandrel from the first position to the second position.

17. The method of claim 16, further comprising sealing an inner surface of a string disposed in the wellbore with the plug in response to displacing the mandrel from the first position to the second position.

18. The method of claim 16, further comprising flowing a fluid from the first chamber to the second chamber through at least one opening formed between an outer surface of the mandrel and an inner surface of the housing.

19. The method of claim 18, wherein the opening comprises an arcuate opening formed between a planar surface of the mandrel and the inner surface of the housing.

20. The setting tool of claim 18, wherein the opening comprises an annular passage formed between a cylindrical groove of the mandrel and the inner surface of the housing.

21. The method of claim 16, further comprising venting the pressure from the first chamber to the second chamber as the plug seals against a tubular string positioned in the wellbore.

* * * * *